US005129693A

United States Patent [19]

Schmitt

[11] Patent Number: 5,129,693

[45] Date of Patent: Jul. 14, 1992

[54] DOORJAMB ANTI-SEPARATION DEVICE

[76] Inventor: Thomas Schmitt, 7002 Auburn Ave., Wauwatosa, Wis. 53213

[21] Appl. No.: 727,866

[22] Filed: Jul. 10, 1991

[51] Int. Cl.[5] ..... E05C 21/02

[52] U.S. Cl. ..... 292/300; 292/DIG. 39; 292/DIG. 41

[58] Field of Search ..... 292/300, 346, 216, 301, 292/340, 341.18, DIG. 40, DIG. 44, DIG. 41

[56] References Cited

U.S. PATENT DOCUMENTS

| | | | |
|---|---|---|---|
| 3,674,296 | 7/1972 | Wanlass et al. | 292/216 |
| 3,831,988 | 8/1974 | Stelma | 292/340 X |
| 4,647,091 | 3/1987 | Roubin | 292/DIG. 53 X |
| 4,702,505 | 10/1987 | Alexander | 292/251 |
| 4,986,576 | 1/1991 | Anderson | 292/DIG. 41 X |

*Primary Examiner*—Richard E. Moore

*Attorney, Agent, or Firm*—Andrus, Sceales, Starke & Sawall

[57] ABSTRACT

A device which prevents separation of a doorjamb and door to provide security against forced entry into a building by an intruder. The device includes a doorjamb plate which is attached to the interior of a hollow metal door frame, and includes a retaining plate which is attached to the interior of a hollow metal door. A bolt head protruding from the doorjamb plate is engageable with a slotted groove in the retaining plate. When the door is closed, the retaining engagement of the bolt head with the slotted groove of the retaining plate prevents an intruder from using a tool such as a crowbar to pry the door open.

9 Claims, 2 Drawing Sheets

DOORJAMB ANTI-SEPARATION DEVICE

BACKGROUND OF THE INVENTION

This invention relates to a device which prevents separation of a doorjamb and door to provide security against forced entry into a building.

The entrance to many apartments, office buildings, schools and other buildings are made of metal doors and door frames which are subject to forced entry by an intruder. Such entranceways are typically arranged so that the door is locked from the outside yet it allows easy exit from the inside. A typical lock set may comprise a latch lock which allows a person exiting the building to pull down on a handle to open the door. The door remains locked from the outside when it is in the closed position.

Despite the fact that the door is closed and locked from the outside, an intruder may still force his way into the building by using a crowbar or other leveraging device to force the door open. The latch on the lock set extends from the edge of the door only about ½" or so, and, when the door is in the closed position, the latch protrudes into a recess in the doorjamb. By inserting a crowbar between the edge of the door and the doorjamb, the intruder may pry them apart far enough so as to separate the latch on the door from the recess in the doorjamb, thus allowing the door to open.

Others have tried placing a metal cover plate on the door over the area where the latch extends into the recess of the doorjamb. Such cover plates are helpful in preventing the intruder from tampering directly with the lock, but the intruder may still pry apart a door and doorjamb far enough so as to separate the latch from the recess in the doorjamb to open the door.

SUMMARY OF THE INVENTION

A doorjamb anti-separation device to provide security against forced entry into a building by an intruder is disclosed.

The invention comprises a doorjamb plate having a protruding bolt head which is attached to the doorjamb, and a slotted, grooved retaining plate which is attached to the door and which is engageable with the bolt head when the door is closed.

The doorjamb plate is inserted into a hole cut in the outer surface of the doorjamb. The doorjamb plate is fastened inside the hollow metal doorjamb and it lies flush with the outer surface of the doorjamb. The bolt head protrudes out from the doorjamb plate.

The retaining plate, which is mounted on the edge of the door near the latch, has a slotted groove. When the door is closed, the slotted groove of the retaining plate engages the protruding bolt head on the doorjamb plate. The doorjamb plate and the retaining plate lie parallel to each other and the retaining plate essentially surrounds the bolt. Thus, any attempt to pry apart the door and the doorjamb will be thwarted due to the retaining engagement of the bolt head in the slotted groove of the retaining plate.

The invention consists of easily manufactured metal plates and a standard round-head bolt, nut, set screw and mounting screws. It is therefore easy and inexpensive to manufacture. The invention also includes a mounting tool for inserting and mounting the doorjamb plate in the doorjamb.

The primary object of the invention is therefore to provide an effective, inexpensive security device which prevents forced separation of a doorjamb and door so as to maintain the integrity of a latch-type lock of a doorway.

Other objects and advantages of this invention will become apparent from the following description taken in connection with the accompanying drawings which set forth, by way of illustration and example, certain embodiments of this invention.

BRIEF DESCRIPTION OF THE DRAWINGS

The drawings, which constitute part of this specification and include an exemplary embodiment of the invention, include the following.

DETAILED DESCRIPTION

Figure 1:
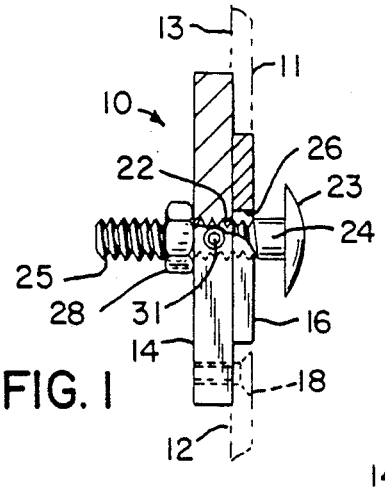
FIG. 1 is a side view partially in section of the doorjamb plate.
Figure 2:
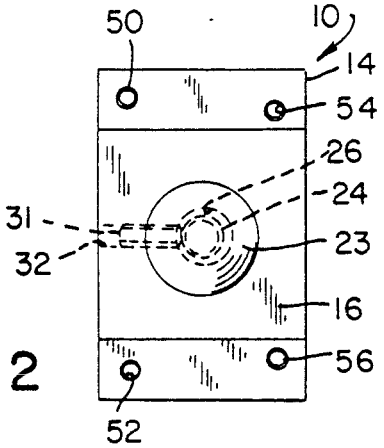
FIG. 2 is a front view of the doorjamb plate.
Figure 3:
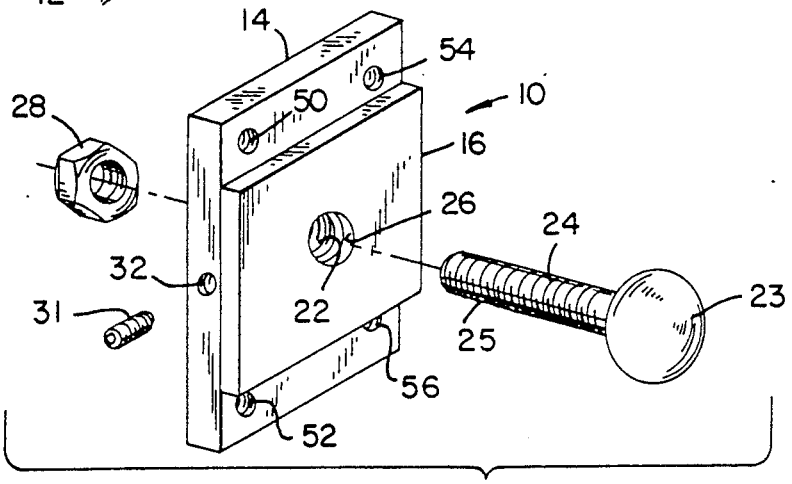
FIG. 3 is an exploded perspective view of the doorjamb plate.

FIGS. 1, 2 and 3 show a doorjamb plate 10 of the invention which is insertable into a hollow metal doorjamb 12. The doorjamb plate 10, which comprises a mounting plate 14 and a cover plate 16, is slipped through a hole cut into the doorjamb 12 and oriented so that the mounting plate 14 lies on the inner surface 13 of the doorjamb 12. Flathead mounting screws 18 inserted through screw holes drilled above and below the hole cut in the doorjamb 12 engage threaded holes in the mounting plate. The cover plate 16 lies flat against the mounting plate 14 in parallel face-to-face relationship so that the outer surface 15 of the cover plate 16 is flush with the outer surface 11 of the doorjamb 12. The size of the cover plate 16 corresponds to the size of the hole cut in the doorjamb 12.

The mounting plate 14 has a threaded central opening 22 engageable with a standard size, threaded round head bolt 24. The cover plate 16 has a central opening 26 (unthreaded) which is aligned with and is greater in diameter than the threaded central opening 22 in the mounting plate 14. The round head bolt 24 is rotatably engaged with the threaded central opening 22 of the mounting plate 14 so that the head 23 protrudes out from the outer surfaces 15 of the cover plate 16 and the threads 25 of the bolt 24 protrude into the interior of the doorjamb 12.

The extent which the bolt head 23 protrudes is adjustable by rotating the bolt 24, and once properly adjusted, a retaining nut 28 on the opposite threaded end 25 of the bolt 24 provides a means for locking the bolt 24 in position. Alternatively, the bolt 24 may be locked into position by tightening a set screw 31 in the mounting plate 14. For the second option, the set screw 31 is inserted in a threaded set screw hole 32 in the side of the mounting plate 14, the set screw hole 32 being perpendicular to the threaded central opening 22. An access hole 34 may be drilled into the face of the doorjamb 12 to readjust the bolt 24 and set screw 31 after initial installation.

Figure 4:
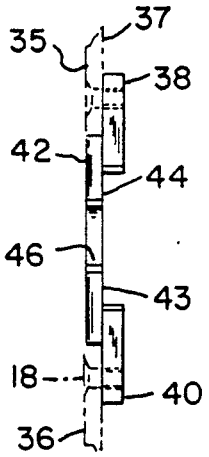
FIG. 4 is a side view of the retaining plate.
Figure 5:
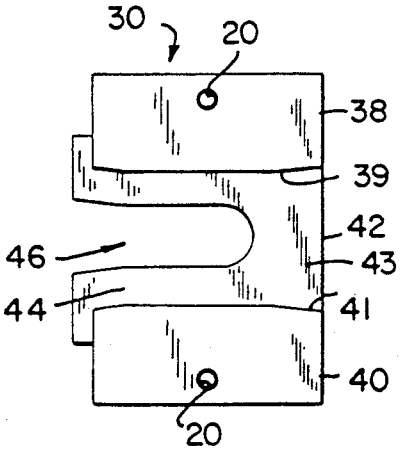
FIG. 5 is a rear view of the retaining plate.
Figure 6:
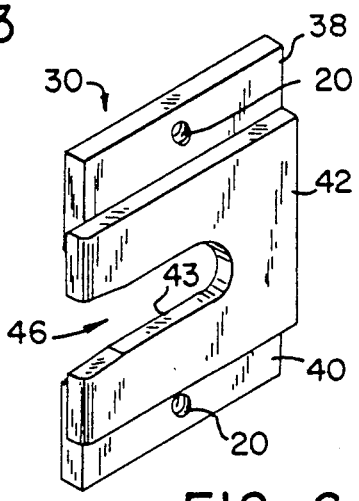
FIG. 6 is a perspective view of the retaining plate.
Figure 8:
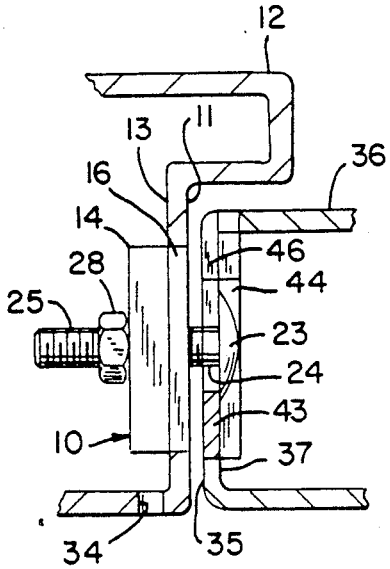
FIGS. 8 and 9 are top views partially in section showing the engaging action of the retaining plate and bolt head as the door closes.
Figure 9:
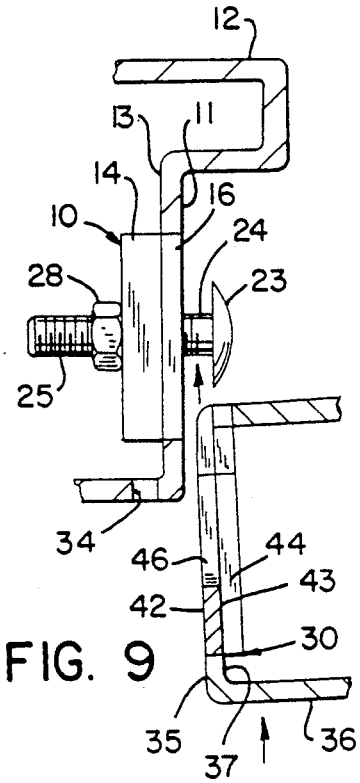

FIGS. 4, 5 and 6 show a retaining plate 30 which is fitted into the edge of a hollow metal door 36 (or into a hollow metal frame-section of a door). Similar to the doorjamb plate, the retaining plate 30 has upper and lower plate sections 38 and 40 which mount against the inside surface 37 of the edge of the door, and a central plate section 42 which is flush with the outer surface 35 of the edge of the door. The upper plate section 38 and the lower plate section 40 are each in parallel adjacent relationship to the central plate section 42. A groove 44 is formed by the lower edge 39 of the upper plate section 38, the rear face 43 of the central plate section 42, and the upper edge 41 of the lower plate section 40. The retaining plate 30 is mounted on the door with flat head mounting screws 18 which engaged threaded screw holes 20 in the upper and lower plate sections 38 and 40. Due to the strength requirements for this piece, the retaining plate 30 is made from a single metal piece which is machined to form the groove.

The central plate section 42 of the retaining plate 30 has a slot 46 formed by a semicircular edge at approximately the center of the central plate section 42 with slightly outwardly flared edges at the side of the retaining plate 30. When the door is closed, the retaining plate 30 engages the bolt 24 so that the shaft of the bolt fits into the slot 46 and the head 23 of the bolt 24 into the groove 44 of the retaining plate 30. The size of the hole cut in the edge of the door corresponds to the size of the central plate section 42 of the retaining plate 30, and the hole extends slightly over the interior face of the door for the bolt head 23 to pass through.

A door, after initial installation, has a tendency to sag. In the event of a sagging door, the retaining plate 30 is shifted vertically downward, resulting in the slot 46 becoming out of alignment with the bolt 24 on the doorjamb plate 10. For this reason, the doorjamb plate 10 is provided with a means for adjusting the vertical position of the bolt 24. This vertical adjusting means is achieved by providing the mounting plate 14 with staggered or offset threaded mounting holes 50, 52, 54 and 56 and providing the cover plate 16 with a central opening 26 which is slightly larger than the threaded central opening 22 of the mounting plate. 14

For example, the mounting plate 14 may be provided with a threaded mounting hole pattern as shown in FIG. 2. In that case, the threaded central opening 22 may be, for instance, a 5/16–18 threaded screw hole, and the upper left and lower left threaded mounting holes 50 and 52 may be 1" from the center line of the threaded central opening, and the upper right and lower right threaded mounting holes 54 and 56 may be ⅞" from the center line. The mounting plate 14 is installed in the doorjamb by using only the upper right and lower left mounting holes 54 and 52, respectively. If the door sags, then the vertical position of the bolt 24 may be lowered ⅛" by flipping the mounting plate 14 over. The cover plate 16, which is adhesively attached to the face of the mounting plate 14, is removed and reattached. The central opening 26 of the cover plate is ½" in this specific case, which is larger than the threaded central opening 22 of the mounting plate 14. This larger diameter hole 26 in the cover plate 16 allows for the vertical readjustment of the bolt 24 yet the cover plate 16 still fits into the hole cut into the doorjamb 12.

Figure 10:
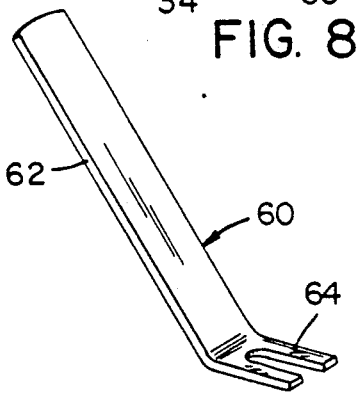
FIG. 10 is a perspective view of a tool for installing the doorjamb plate.
Figure 7:
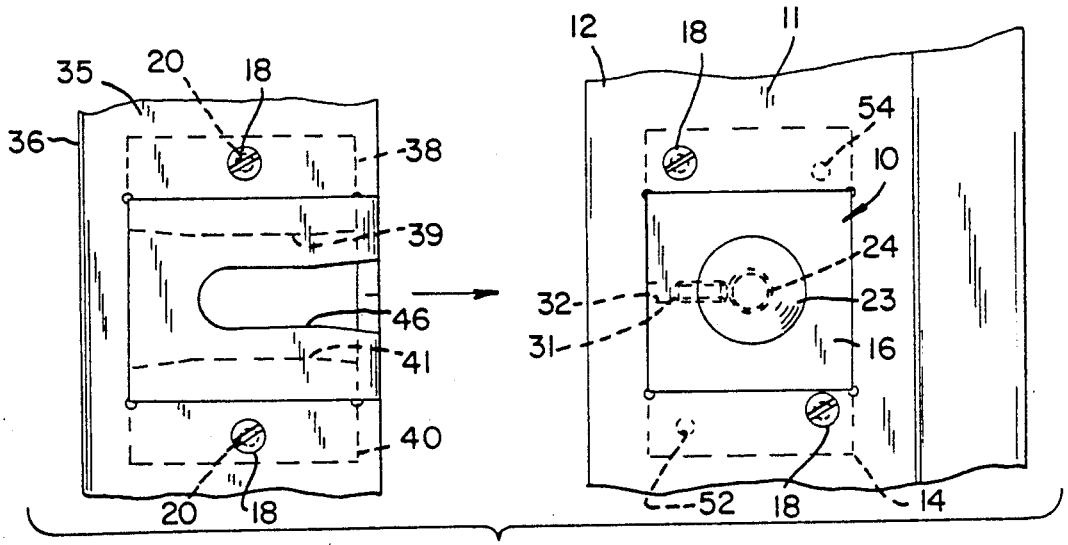
FIG. 7 is an elevational view showing the doorjamb plate installed on the doorjamb and the retaining plate installed on the door.

The invention further has a tool 60 for installing the doorjamb plate 10. The tool 60, as shown in FIG. 10, comprises a flat elongated plate member 62 having on one end an angled, slotted portion 64 engageable with the round head bolt 24 on the doorjamb plate 10.

It is to be understood that the embodiments disclosed above are merely exemplary of the invention which may be embodied in various forms. Therefore, specific structural and functional details disclosed above are not to be interpreted as limiting, but merely as a basis for the claims and as a representative basis for teaching one skilled in the art to variously employ the present invention in any appropriately detailed structure. Changes may be made in the details of construction and arrangement of the invention without departing from the spirit of the invention, especially as defined in the following claims.

I claim:

1. A doorjamb anti-separation device comprising:

a doorjamb plate comprising:

a mounting plate having a threaded central opening and staggered mounting holes;

a cover plate having a central opening substantially aligned with the threaded central opening, the cover plate being in parallel face-to-face relationship with the mounting plate, and the central opening of the cover plate is slightly larger than the threaded central opening of the mounting plate;

a threaded bolt rotatably engaged with the threaded central opening; and a means for locking the bolt in position;

a door retaining plate comprising:

an upper plate section and a lower plate section each being in parallel adjacent relationship to a central plate sections so as to form a groove;

the upper plate section and lower plate section each having a mounting hole; and the central plate section having a slot engageable with the bolt on the doorjamb plate.

2. The doorjamb anti-separation device of claim 1, wherein the means for locking the bolt in position is a nut on the threaded end of the bolt.

3. The doorjamb anti-separation device of claim 1, wherein the means for locking the bolt in position is a threaded set screw hole extending from the side edge of the mounting plate to the threaded central opening and being perpendicular to the threaded central opening, and a set screw rotatably inserted in the set screw hole.

4. The doorjamb anti-separation device of claim 1, wherein the cover plate is adhesively attached to the mounting plate.

5. A doorjamb anti-separation assembly comprising:

a hollow doorjamb having an inner surface, an outer surface and a hole formed therethrough;

a doorjamb plate comprising a mounting plate having a threaded central opening and mounting holes, a cover plate having a central opening substantially aligned with the threaded central opening, the cover plate being in parallel face-to-face relationship with the mounting plate, said cover plate defining an outer surface and dimensioned to be smaller than said mounting plate and to correspond to the size of the hole in the doorjamb; a threaded bolt rotatably engaged with the threaded central opening, a means for locking the bolt in position, and means for mounting said doorjamb plate to said doorjamb such that the mounting plate bears against the inner surface of said doorjamb and the outer surface of the cover plate is flush with the outer surface of the doorjamb;

a hollow door section including an edge having an inner surface, an outer surface and a hole formed therethrough; and a door retaining plate comprising an upper plate section and a lower plate section each being in parallel adjacent relationship to a central plate section so as to form a groove, said central plate section defining an outer surface and dimensioned to correspond to the size of the hole in the door section, the upper plate section and lower plate section each having mounting holes, means for mounting said door retaining plate to said hollow door section such that the upper and lower plate sections bear against the inner surface of said door section and the outer surface of the central plate section is flush with the outer surface of the door section, and the central plate section having a slot engageable with the bolt on the doorjamb plate when the door section is moved to a closed position.

6. The doorjamb anti-separation assembly of claim 5, wherein the means for locking the bolt in position is a nut on the threaded end of the bolt.

7. The doorjamb anti-separation assembly of claim 5, wherein the means for locking the bolt in position is a threaded set screw hole extending from the side edge of the mounting plate to the threaded central opening and being perpendicular to the threaded central opening, and a set screw rotatably inserted in the set screw hole.

8. The doorjamb anti-separation device of claim 5, wherein the mounting plate has staggered mounting holes, and the central opening of the cover plate is slightly larger than the threaded central opening of the mounting plate.

9. The doorjamb anti-separation device of claim 8, wherein the cover plate is adhesively attached to the mounting plate.

* * * * *